US008207621B2

(12) United States Patent
Hunter

(10) Patent No.: US 8,207,621 B2
(45) Date of Patent: Jun. 26, 2012

(54) MODULAR PANELS FOR ENCLOSURES

(75) Inventor: Jefferey Allen Hunter, Troy, OH (US)

(73) Assignee: F3 & I2, LLC, Troy, OH (US)

( * ) Notice: Subject to any disclaimer, the term of this patent is extended or adjusted under 35 U.S.C. 154(b) by 964 days.

(21) Appl. No.: 12/205,442

(22) Filed: Sep. 5, 2008

(65) Prior Publication Data

US 2010/0025409 A1 Feb. 4, 2010

Related U.S. Application Data

(63) Continuation of application No. PCT/US2008/075116, filed on Sep. 3, 2008.

(60) Provisional application No. 61/085,241, filed on Jul. 31, 2008.

(51) Int. Cl.
*F02B 63/00* (2006.01)
*F02D 25/00* (2006.01)

(52) U.S. Cl. ..... 290/1 A; 132/2

(58) Field of Classification Search ..... 290/1 R, 290/1 A, 1 B, 2; 123/2, 3
See application file for complete search history.

(56) References Cited

U.S. PATENT DOCUMENTS

| | | | |
|---|---|---|---|
| 1,779,786 | A | 10/1930 | Unzue |
| 1,950,234 | A | 3/1934 | Ewertz |
| 2,601,634 | A | 6/1952 | Rivette |
| 2,927,711 | A | 3/1960 | Naggiar |
| 3,948,314 | A | 4/1976 | Creswick et al. |
| 3,966,285 | A | 6/1976 | Porch et al. |
| 4,136,432 | A | 1/1979 | Melley, Jr. |
| 4,168,740 | A | 9/1979 | Cairenius |
| 4,548,164 | A | 10/1985 | Ylonen et al. |
| 4,644,705 | A | 2/1987 | Saccomani et al. |
| 5,181,541 | A | 1/1993 | Bodenheimer |
| 5,205,427 | A | 4/1993 | Crago et al. |
| 5,381,915 | A | 1/1995 | Yardley |

(Continued)

FOREIGN PATENT DOCUMENTS

EP 0594226 A2 4/1994

(Continued)

OTHER PUBLICATIONS

International Search Report and Written Opinion pertaining to International application No. PCT/US2008/075116 dated Jul. 5, 2010.

*Primary Examiner* — Nicholas Ponomarenko
(74) *Attorney, Agent, or Firm* — Dinsmore & Shohl LLP

(57) ABSTRACT

Embodiments of the present invention relate generally to energy generating modules. More particularly, embodiments relate generally to energy generating modules that comprise energy generating devices and pluralities of modular panels comprising fuel chambers. The modular panels respectively comprise one or more multi-functional inter-panel coupling ports positioned to facilitate multi-purpose modular interconnection of complementary modular panels and exhibit a degree of structural rigidity sufficient to contribute to immobilization of interconnected complementary modular panels relative to each other. The complementary modular panels are interconnected via the multi-functional inter-panel coupling ports to form an enclosure such that the fuel chambers of the interconnected complementary modular panels are disposed between an exterior of the enclosure and an interior of the enclosure. The energy generating device is in fluid communication with one or more of the fuel chambers and is configured to generate an energy output with fuel received from the fuel chambers.

19 Claims, 4 Drawing Sheets

U.S. PATENT DOCUMENTS

| | | | | |
|---|---|---|---|---|
| 5,402,968 | A | 4/1995 | Baldwin et al. | |
| 5,460,013 | A | 10/1995 | Thomsen | |
| 5,575,349 | A | 11/1996 | Ikeda et al. | |
| 5,642,827 | A * | 7/1997 | Madsen | 220/1.5 |
| 5,744,940 | A | 4/1998 | Colton et al. | |
| 5,804,946 | A * | 9/1998 | Gaubatz et al. | 322/1 |
| 5,816,425 | A | 10/1998 | Keip et al. | |
| 6,142,301 | A | 11/2000 | Lin et al. | |
| 6,206,252 | B1 | 3/2001 | Broadus | |
| 6,231,284 | B1 | 5/2001 | Kordel | |
| 6,276,549 | B1 | 8/2001 | Fasci et al. | |
| 6,283,527 | B1 | 9/2001 | Desmarais | |
| 6,347,678 | B1 | 2/2002 | Osborn et al. | |
| 6,393,775 | B1 | 5/2002 | Staschik | |
| 6,422,018 | B1 | 7/2002 | Tisdale et al. | |
| 6,442,018 | B1 | 8/2002 | Dinkin | |
| 6,520,124 | B2 | 2/2003 | Bohm, II | |
| 6,601,542 | B2 * | 8/2003 | Campion | 123/2 |
| 6,615,741 | B2 | 9/2003 | Fecko et al. | |
| 6,824,338 | B2 | 11/2004 | Looker | |
| 6,996,951 | B2 | 2/2006 | Smith et al. | |
| 7,021,009 | B2 | 4/2006 | Johnson | |
| 7,081,682 | B2 * | 7/2006 | Campion | 290/1 A |
| 7,104,583 | B2 | 9/2006 | Clare | |
| 7,122,913 | B2 * | 10/2006 | Witten et al. | 290/1 A |
| 7,351,485 | B2 | 4/2008 | Shioya | |
| 7,589,429 | B2 * | 9/2009 | Hunter | 290/1 A |
| 7,619,319 | B1 * | 11/2009 | Hunter | 290/4 R |

FOREIGN PATENT DOCUMENTS

| | | | |
|---|---|---|---|
| FR | 2558806 | A1 | 8/1985 |
| JP | 62-144726 | U | 9/1987 |
| JP | 2005060053 | A | 3/2005 |
| KR | 20080073896 | A | 8/2008 |

* cited by examiner

MODULAR PANELS FOR ENCLOSURES

CROSS-REFERENCE TO RELATED APPLICATIONS

The present application is filed under 35 U.S.C. 111(a) as a continuation of International Patent Application No. PCT/US08/75116 (HUR 0006 PB), which international application designates the United States and claims the benefit of U.S. Provisional Application Ser. No. 61/085,241 (HUR 0006 MA), filed Jul. 31, 2008.

BACKGROUND

Conventional power generating systems generally are used to generate electric power either in remote areas where access to electricity is limited or in urban areas to provide backup power during power outages. More particularly, such conventional systems typically utilize a diesel engine to generate the needed electric power, which may be used for both prime (primary source) and backup (redundant source) power. Power generating systems commonly are used for industrial, construction, mining, oil and gas exploration, and other commercial applications. For example, for industrial applications, the power generating systems may be used to support prime and/or backup electric power for factories; for construction, mining, and oil and gas exploration applications, the power generating systems may be used to generate prime power for the operation of equipment, given that the locations of such activities often are too remote and distant from municipal power grids; and, for commercial applications, the power generating systems may provide backup electric power for electrical systems should the municipal power grid temporarily lose power due to a storm, natural disaster, sabotage, etc.

Power generating systems typically generate significant amounts of noise, are very expensive, and may be transportable from one location to another. As such, power generating systems generally are enclosed in order to reduce the amount of noise escaping to the surrounding outside environment, to protect the engine and other components from theft and environmental conditions, and to facilitate their transportation. A common enclosure for power generating systems are standard shipping containers, such as ISO (International Organization for Standardization) shipping containers. Enclosure of power generating systems within such containers enables the systems to be easily and rapidly deployed to variously located job sites. Another common enclosure for power generating systems are drop-over enclosures that may be designed in a variety of dimensions and configurations. Drop-over enclosures typically are used for power generating systems intending to have a fixed location, such as atop a commercial building.

Depending upon the unique customer requirements, which, in large part, may be dictated by federal, state, and local laws, additional equipment may be needed to operate and support the power generating systems. This equipment may include, but is not limited to, the following: DC lighting systems, electrical controls such as switchgear or a voltage changeover board, sound attenuation, fire suppression systems, personnel doors, fuel tank, louvers for ventilation, and an exhaust system. With the footprint of the enclosure often being constrained, due to the power generating system's proximity to buildings, equipment, etc., designers of power generating systems may seek to minimize the dimensions of internal components of the power generating system, including the engine, such that the overall footprint of the enclosure may be minimized. Alternatively, when using a standard shipping container, the outside dimensions are fixed. Therefore, all of the required components must be sized so as to fit inside of the container.

Power generating systems using liquid fuels, such as petroleum-based fuels, may present problems in attempting to minimize sizes of necessary components. For not only must fuel tanks meet all federal, state, and local laws, but fuel tanks must also fulfill the engine's fuel supply requirements within the available space of the enclosure. Therefore, there is a desire to maximize the size of the fuel tank in order reduce the frequency of necessary and costly refuelings of the power generating system that competes with the desire to minimize the size of the power generating modules and their components.

Further, conventional fuel tanks are designed and built in cylindrical, square, and rectangular shapes as discrete components connected to the engine via tubes and hoses. Given the size and shape of existing liquid fuel engines most commonly used, designers generally must install the fuel tank in the nose (front), in the tail (rear), or beneath the engine. If the fuel tank is to meet Underwriters Laboratories' standards for fuel containment, then the fuel tank must be double-walled such that if an exterior wall is pierced, an uncompromised interior wall prevents the fuel from leaking. Also, conventional fuel tanks may create uneven surfaces within interiors of the power generating systems, particularly in workspace areas. For example, if a fuel tank is positioned below the engine, its exterior walls may create a trip hazard and/or create uneven floor or wall surfaces, making it more difficult for a designer to optimize space within the interior of the power generating system.

SUMMARY

Embodiments of the present invention relate generally to energy generating modules. More particularly, embodiments relate generally to energy generating modules that comprise energy generating devices and pluralities of modular panels comprising fuel chambers, wherein modular panels are interconnected to form enclosures for the energy generating devices such that the fuel chambers of the modular panels are disposed between exteriors and interiors of the enclosures.

In accordance with one embodiment, an energy generating module comprises an energy generating device and a plurality of modular panels. The modular panels comprise fuel chambers that are configured to contain fuel. In addition, the modular panels respectively comprise one or more multi-functional inter-panel coupling ports. The multi-functional inter-panel coupling ports are positioned to facilitate multi-purpose modular interconnection of complementary modular panels and exhibit a degree of structural rigidity sufficient to contribute to immobilization of interconnected complementary modular panels relative to each other. Also, the multi-functional inter-panel coupling ports comprise fluid passages for conveying fuel between interconnected complementary modular panels. The complementary modular panels are interconnected via the multi-functional inter-panel coupling ports to form an enclosure such that the fuel chambers of the interconnected complementary modular panels are disposed between an exterior of the enclosure and an interior of the enclosure. The energy generating device is in fluid communication with one or more of the fuel chambers and is configured to generate an energy output with fuel received from the fuel chambers.

In accordance with another embodiment, a power generating module comprises a power generating device and a plurality of modular panels. The modular panels comprise fuel chambers that are configured to contain fuel. In addition, the modular panels respectively comprise one or more multi-functional inter-panel coupling ports configured as complementary pins and recesses. The power generating device is in fluid communication with one or more of the fuel chambers and is configured to generate an electric power output with fuel received from the fuel chambers.

BRIEF DESCRIPTION OF THE DRAWINGS

The following detailed description of specific embodiments can be best understood when read in conjunction with the following drawings, where like structure is indicated with like reference numerals and in which.

Figure 1:
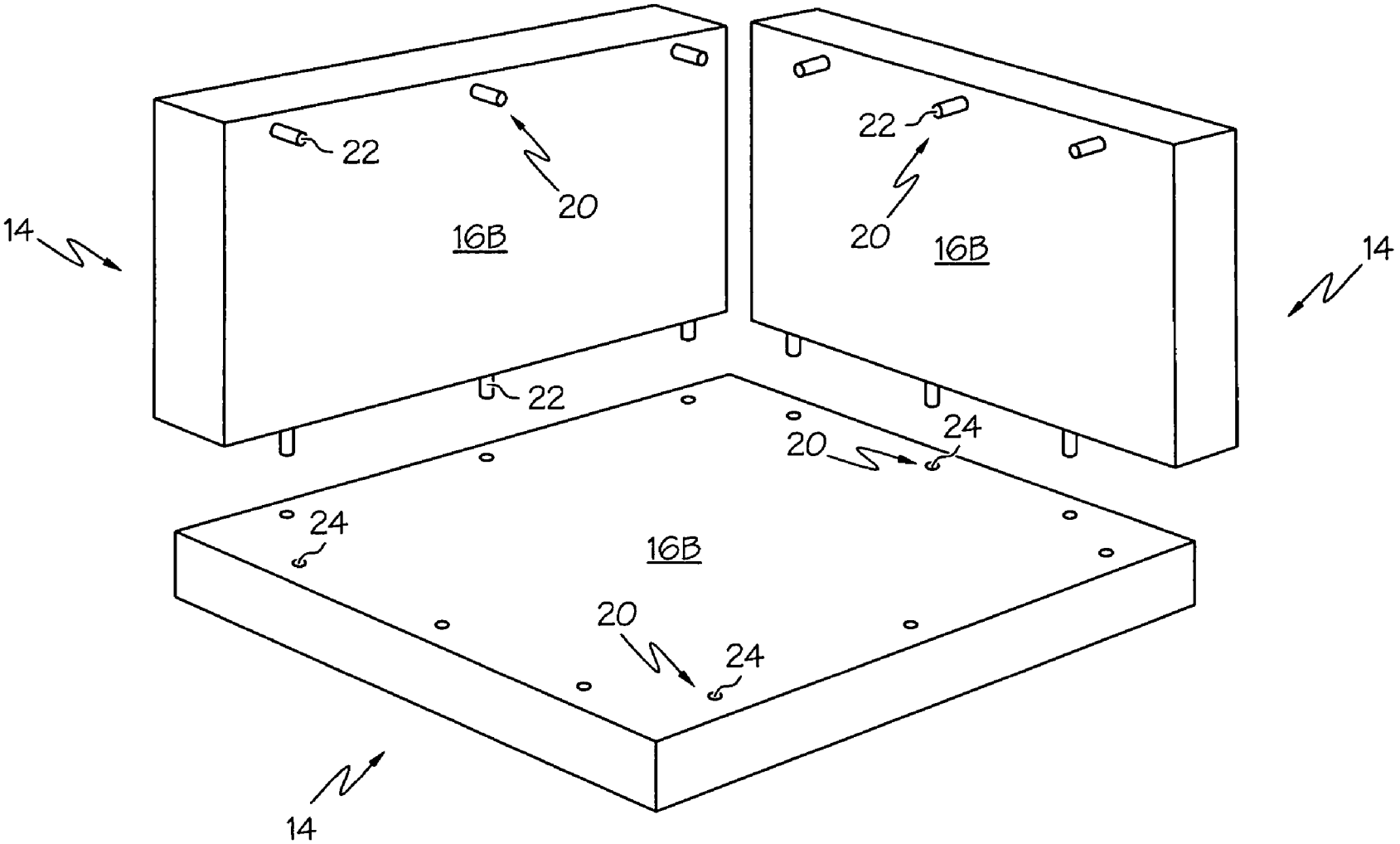
FIG. 1 is an illustration of a perspective view of a plurality of modular panels according to one embodiment.

The embodiments set forth in the drawings are illustrative in nature and are not intended to be limiting of the embodiments defined by the claims. Moreover, individual aspects of the drawings and the embodiments will be more fully apparent and understood in view of the detailed description.

DETAILED DESCRIPTION

Embodiments of the present invention relate generally to energy generating modules. An energy generating module comprises an energy generating device and a plurality of a modular panels. These modular panels comprise fuel chambers that are configured to contain fuel. The energy generating device may utilize fuel contained in the fuel chambers to generate an energy output. For example, but not by way of limitation, the energy generating device may be a generator engine that generates electric power output, a boiler that generates heat and/or warm air output, a chiller that generates cool air output, an air compressor that generates forced air output, or any other energy generating device configured to generate or otherwise produce an energy output. The energy output may be transferred by the energy generating module, via an energy transfer receptacle or otherwise, to any device or system consuming, transferring, or otherwise utilizing the generated energy output. As used herein, "transfer" refers to a transmission, discharge, or other distribution of an energy output from the energy generating module to any energy consuming or transferring device or system, such as, but not limited to, a vehicle, a battery or other energy storing device, and a power grid. Solely for purposes of simplifying the description of various embodiments of the present invention, the disclosure provided herein refers generally to energy generating modules and not to any particular type of energy generating module, such as, for example, a power generating module that comprises a power generating device configured to generate electric power output with fuel receive from its fuel chamber. As such, the disclosure provided herein is not limited to any particular type or types of energy generating modules and is applicable to any type of energy generating module, as described herein. Further, as used herein, the term "module" refers to any configurable enclosure, whether transportable or fixed at a location, capable of at least partially enclosing an energy generating device to produce an energy output for one or more of any variety or combination of uses.

Figure 3:
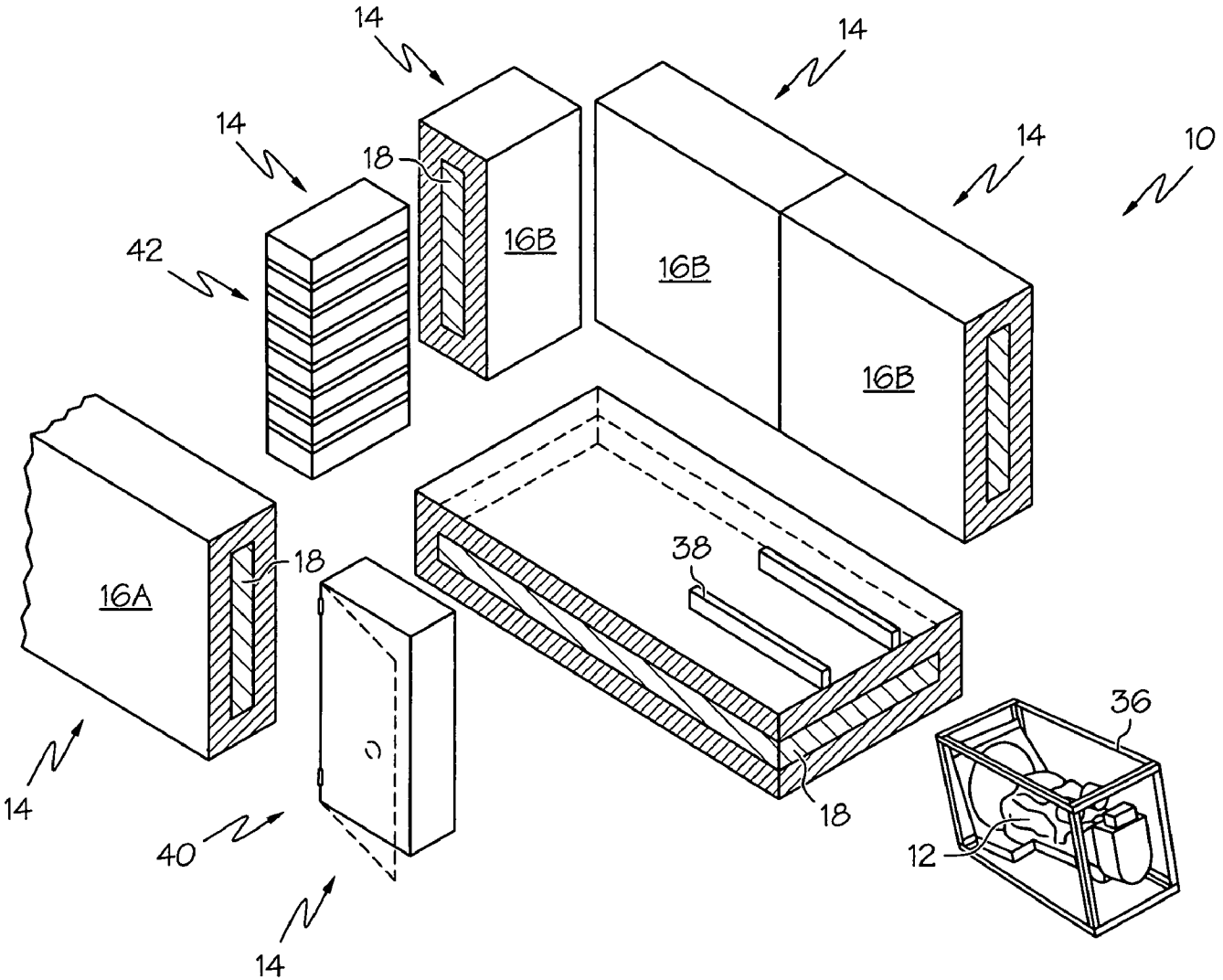
FIG. 3 is an illustration of cross-sectional views of a plurality of modular panels according to another embodiment.

Referring initially to FIG. 3, an energy generating module 10 generally comprises an energy generating device 12 and a plurality of modular panels 14 comprising fuel chambers 18 configured to contain fuel. The energy generating device 12 generally, but not necessarily, is an fuel-driven engine configured to generate an energy output, such as electric power output. The energy generating device 12 may be, for example, a turbine engine, a reciprocating engine, an electric/gasoline (or other hybrid) engine, a combined heat and power engine (CHP), which may be used to direct the heat generated by the engine to a nearby facility for a productive use, a hydrogen fuel cell engine, a solar-powered engine, or a wind-driven engine. In fact, the energy generating module 10 may comprise one or more of any combination of energy generating devices 12 to enhance flexibility and/or energy output generation of the energy generating module 10. With respect to the exemplary wind-driven engine embodiment, wind turbines, for example, may be mounted onto an exterior of the energy generating module 10 to generate an energy output, whether during transportation or while the energy generating module 10 is stationary. With respect to the exemplary solar-powered engine, solar panels, for example, may be provided to an exterior of the energy generating module 10 to generate an energy output. It is contemplated that the energy generating module 10 may comprise one or more of any variety of types of energy generating devices 12 to generate one or more types of energy outputs. For exemplary purposes only, the energy generating module 10 may comprise a turbine engine, a solar-powered engine, and a boiler, the energy generating module 10 may comprise a hydrogen fuel cell engine and a turbine engine, or the energy generating module 10 may comprise an electric/gasoline engine and a biofuel engine. With respect to an energy generating device 12 configured as a fuel-driven engine, the energy generating device 12 may be in fluid communication with one or more of the fuel chambers 18 of the modular panels 14 and configured to generate an energy output with fuel received from the fuel chambers 18.

Figure 2:
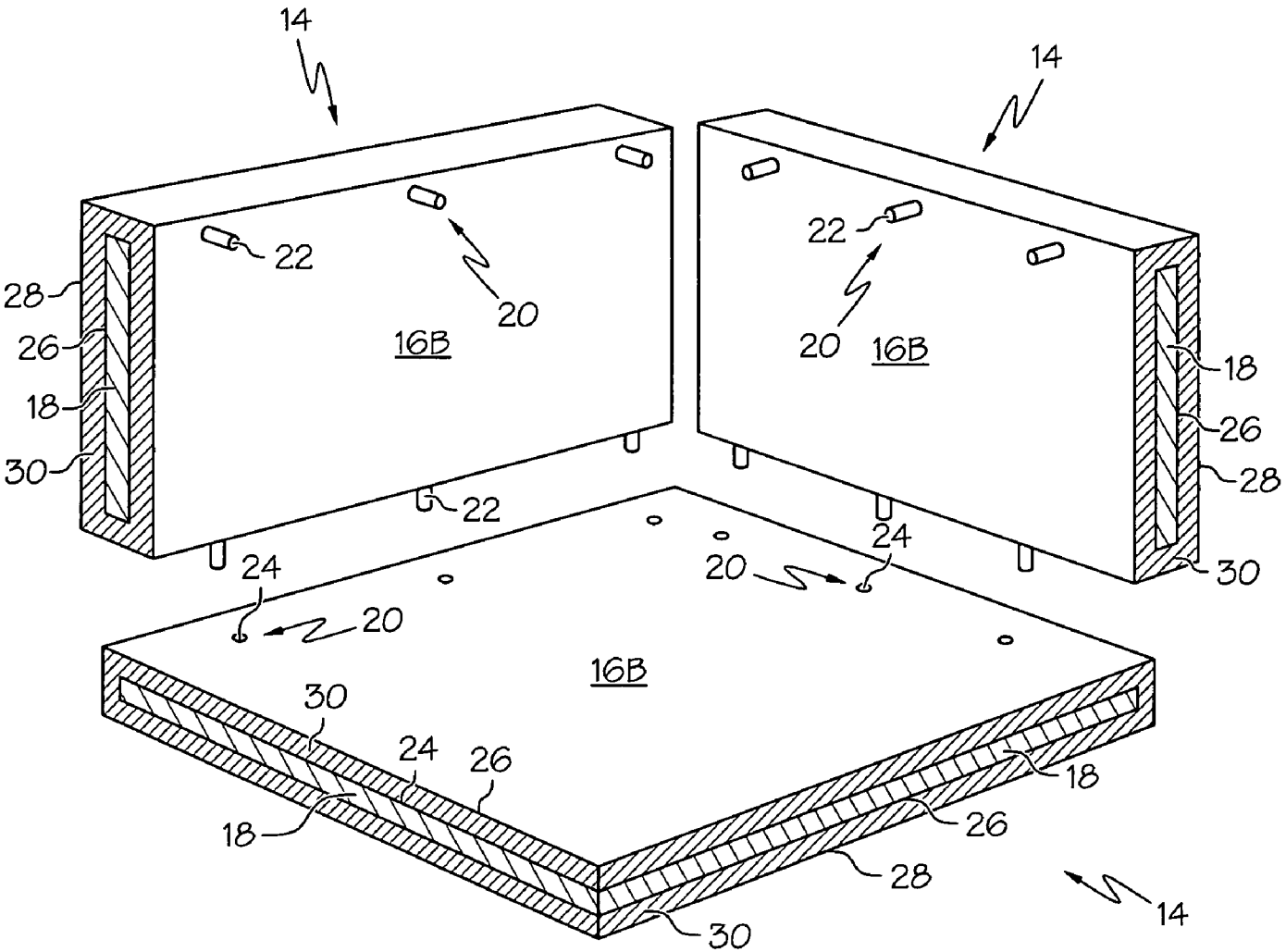
FIG. 2 is an illustration of cross-sectional views of a plurality of modular panels according to another embodiment.

Referring to FIGS. 1-3, in addition to comprising fuel chambers 18 configured to contain fuel, the plurality of modular panels 14 of the energy generating module 10 also are used to form an enclosure 16. More particularly, complementary modular panels 14 may be interconnected, as described in greater detail below, to form an enclosure 16 for the energy generating device 12. For the purposes of defining and describing the present invention, "modular" panels are panels that can interconnect in a variety of configurations, for a variety of purposes, to form part or all of an enclosure 16. For example, modular panels 14 disclosed herein can simply serve as multi-purpose wall panels suitable for use in any part of an enclosure wall or, at a more sophisticated extreme, can serve as wall panels in different parts of an enclosure wall, as ceiling panels in different parts of an enclosure ceiling, as louver panels, window-abutting panels, door panels, corner panels, floor panels, etc. Such configurations of modular interconnection include, but are not limited to, rectangular, square, triangular, hexagon, or any other polygonal shape when the modular panels 14 comprise a linear design. It is also contemplated that the modular panels 14 may be circular, semi-circular, or other curved design such that, when interconnected with other modular panels 14, of linear and/or curved design, any variety of configurations of modular interconnection and/or orientations of enclosures 16 may be formed. Curved modular panels 14 may enhance the ability of the enclosure 16 to reduce the noise emanating from the energy generating device 12 that escapes the enclosure 16 to the surrounding environment. Further, curved modular panels 14 may comprise one or more channels to substantially direct noise though specially designed ports to minimize the amount noise projected to the surrounding environment. In addition, the ability of the modular panels 14 to interconnect is multi-purpose in that the modular panels 14 may interconnect at one or more of any variety of respective areas of the modular panels 14 to form an enclosure 16 of any orientation. More particularly, as used herein, "multi-purpose" refers to the modular interconnection of complementary modular panels 14 at respective mid-points of wall panels, respective end-points of wall panels, ceiling panels, corner panels, floor panels, etc, and to an ability of the modular panels 14 to fuel to flow through interconnected modular panels 14 via multi-functional inter-panel coupling ports 20, as described in greater detail below.

While the modular panels 14 comprise fuel chambers 18, the modular panels 14 respectively comprise one or more multi-functional inter-panel coupling ports 20, as shown in FIGS. 1 and 2. As used herein, "multi-functional" refers to the ability of the multi-functional inter-panel coupling ports 20 to interconnect and to permit passage of fuel between interconnected modular panels 14, as described in greater detail below. The multi-functional inter-panel coupling ports 20 generally are positioned along an exterior surface of the modular panels 14 to facilitate multi-purpose modular interconnection of complementary modular panels 14 for forming an enclosure 16. The complementary modular panels 14 are interconnected via the multi-functional inter-panel coupling ports 20 to form an enclosure 16 such that the fuel chambers 18 of the interconnected complementary modular panels 14 are disposed between an exterior 16A of the enclosure 16 and an interior 16B of the enclosure 16. The multi-functional inter-panel coupling ports 20 may be provided in any configuration, or combination of configurations, sufficient to perform one or more of the purposes of the multi-functional inter-panel coupling ports 20 described herein. In one exemplary embodiment, the multi-functional inter-panel coupling ports 20 are configured as complementary pins 22 and recesses 24, as shown in FIGS. 1 and 2. In another exemplary embodiment, the multi-functional inter-panel coupling ports 20 are configured as complementary tongue and groove connectors. In yet another exemplary embodiment, the multi-functional inter-panel coupling ports 20 are configured as complementary dovetail connectors.

Figure 4:
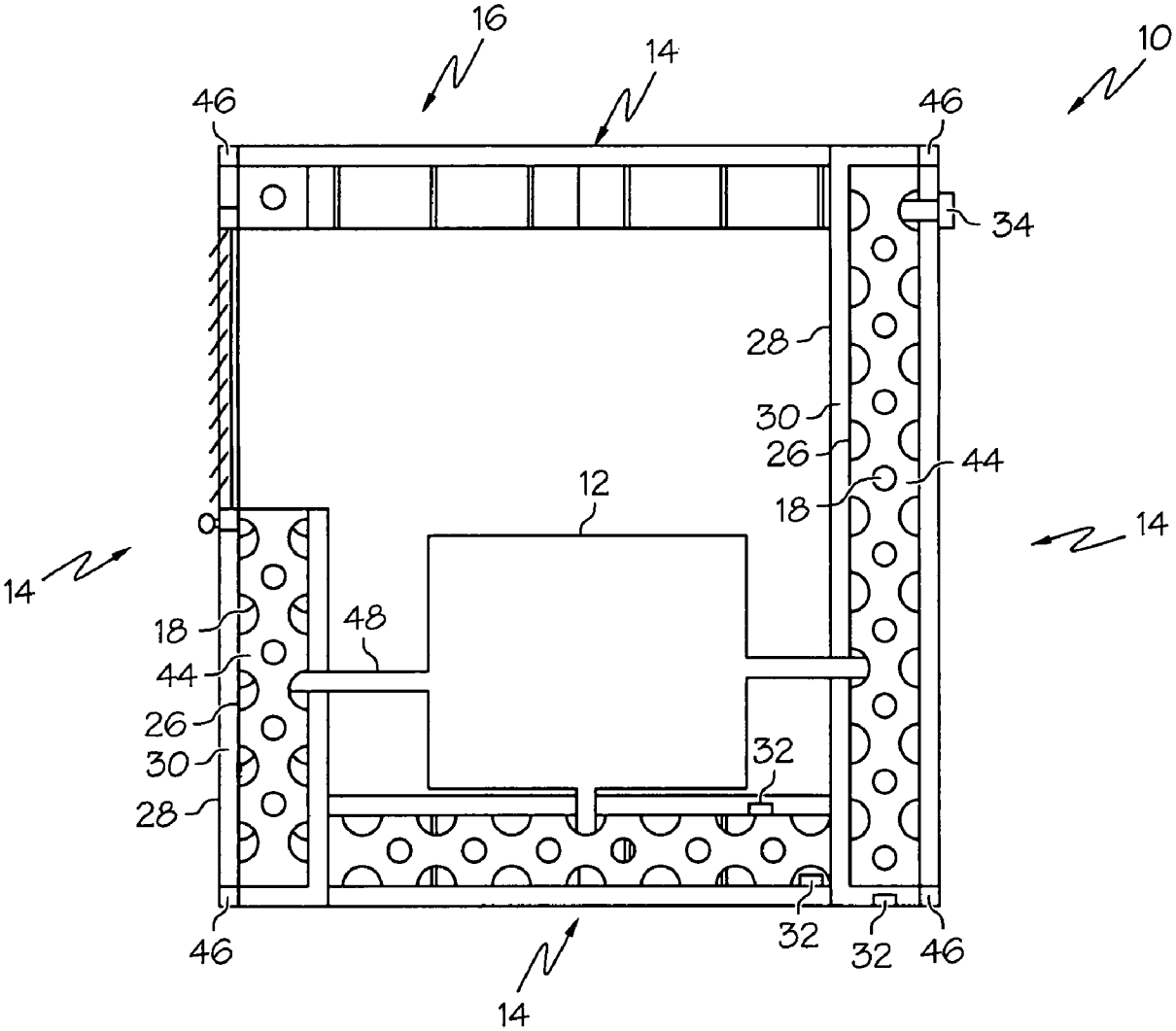
FIG. 4 is an illustration of a cross-sectional view of an energy generating module according to another embodiment.

The multi-functional inter-panel coupling ports 20 exhibit a degree of structural rigidity sufficient to contribute to immobilization of interconnected complementary modular panels 14 relative to each other, which may enhance the structural rigidity of the enclosure 16 as well. In addition, as shown in FIG. 4, the enclosure 16 formed by the interconnected complementary modular panels 14 may be supported by a frame 46. The frame 46 may provide additional structural rigidity to the interconnected complementary modular panels 14 to contribute to the immobilization of the interconnected complementary modular panels 14 relative to each other, which may enhance the structural rigidity of the enclosure 16 as well. The frame 46 also may be configured to protect exterior corners and/or other exterior surfaces, of the enclosure 16 from damage during re-positioning or transportation, or both, of the energy generating module 10.

The multi-functional inter-panel coupling ports 20 also may permit disengagement of interconnected complementary modular panels 14. As such, an enclosure 16 may be partially or entirely disassembled to facilitate transportation of the enclosure 16 and/or the modular panels 14. In addition, one or more of the complementary modular panels 14 forming the enclosure 16 may be disengaged from other complementary modular panels 14 for repair or replacement purposes should, for example, a modular panel 14 be damaged or the ability to contain fuel is compromised.

To further inhibit undesirable disengagement of the interconnected complementary modular panels 14 forming the enclosure 16, the multi-functional inter-panel coupling ports 20 may interlock. The interlocking of the multi-functional inter-panel coupling ports 20 may be achieved in one or more of any variety of ways, whether by insertable locking pins, retractable levers, or otherwise. The modular panels 14 may comprise one or more release mechanisms to control release of interlocked multi-functional inter-panel coupling ports 20 to permit disengagement of interconnected complementary modular panels 14. The release mechanisms may be controllable manually at the modular panels 14, such as, with a manual withdrawal of a locking pin from multi-functional inter-panel coupling ports 20 or with actuation of a knob or button to disengage retractable levers from an interlocked state. In addition, or alternative thereto, the release mechanisms may be controllable remotely from the modular panels 14, such as under direction from a monitoring station monitoring and/or controlling the energy generating module 10, as described in greater detail below.

Further, the multi-functional inter-panel coupling ports 20 may comprise fluid passages. The fluid passages may convey fuel between interconnected complementary modular panels 14. As such, fuel contained in the fuel chambers 18 may flow between the interconnected complementary modular panels 14. Thereby, levels of fuel in the fuel chambers 18 may empty and refill with fuel relatively uniformly with conveyance of fuel to the energy generating device 12 and with introduction of fuel into the fuel chambers 18. To prevent leakage of fuel from between the interconnected complementary modular panels 14, the multi-functional inter-panel coupling ports 20 may comprise seals, gaskets, o-rings, other sealing devices, or combinations thereof, that may effectively seal the modular interconnections of the complementary modular panels 14 at the multi-functional inter-panel coupling ports 20.

With respect to the fuel chambers 18, as mentioned above, the complementary modular panels 14 are interconnected to form an enclosure 16 such that the fuel chambers 18 of the interconnected complementary modular panels 14 are disposed between an exterior 16A of the enclosure 16 and interior 16B of the enclosure 16, as shown in FIGS. 2 and 3. In one exemplary embodiment, shown in FIGS. 2-4, the fuel chambers 18 may be described as double-walled fuel chambers. More particularly, the fuel chambers 18 may respectively comprise a primary containment tank 26 contained within a secondary containment tank 28. The primary containment tank 26 is configured to contain fuel, while the exterior surface of the secondary containment tank 28 defines the exterior of the respective modular panel 14. The primary and secondary containment tanks 26, 28 may be separated by one or more interstitial spaces 30. The width of the interstitial spaces 30 between the primary and secondary containment tanks 26,28 may be determined by regulations or industry standards or otherwise. While the primary containment tank 26 may be sealed to substantially preclude fuel leakage therefrom, leakage may occur due to a manufacturing defect in the energy generating module 10, a compromising of the primary and secondary containment tanks 26, 28 from collision with or puncturing by a foreign object, or other reason. As such, the interstitial spaces 30 may be configured to collect fuel that may leak from the primary containment tank 26. It is also contemplated that the secondary containment tank 28 may also be sealed so as to substantially preclude fuel leakage from the interstitial spaces 30 across the secondary containment tank 28 to the exterior 16A and/or interior 16B of the enclosure 16.

In addition, one or more of the interstitial spaces 30 may be at least partially filled with concrete, insulation, or other matter to further attenuate noise emanating from the energy generating device 10 and to restrict the puncturing of the primary containment tank 26 with a foreign object. This insulating matter may be further configured or provided in such a way within the interstitial spaces 30 to permit a flow of fuel therethrough so as not to obstruct fuel from appropriate sensing by the energy generating module 10, as described in greater detail below. Further, dimensions of the interstitial spaces 30 may be maintained by a brace that may be welded perpendicularly or angularly to the walls of the primary and secondary containment tanks 26, 28. This brace may be configured to allow fuel to pass therethrough should there be a leak in the primary containment tank 30 and to support the primary and secondary containment tanks 26, 28.

Further, the energy generating module 10 may comprise one or more fuel sensors 32 positioned in the interstitial spaces 30 to sense a presence of fuel therein due to a leak in the primary containment tank 30. The interstitial spaces 30 generally are configured to direct fuel collected therein to a position of the fuel sensor 32 for sensing.

In another exemplary embodiment, the fuel chambers 18 may be described as a single-walled fuel chambers, where, rather than comprising primary and secondary containment tanks 26, 28, the fuel chambers 18 respectively comprise a single tank, the exterior surface of which defines the respective modular panel 14. Additional embodiments of the fuel chambers 18 are contemplated wherein the fuel chambers 18 are configured as any multiple-wall structure, whether double-wall, triple-wall, or other, that comprises a plurality of containment tanks.

Further, the fuel chambers 18, both single-walled and multiple-walled embodiments, potentially provide significantly more cubic space for fuel containment given the amount of square feet along all six walls of the enclosure 16 can provide significantly more fuel capacity when compared to conventional energy generating module fuel tanks. Therefore, depending upon the rate of fuel consumption, the runtime of the energy generating module 10 in generating an energy output may increase significantly and may require far fewer refueling trips for a fuel tanker and manpower to refuel the energy generating module 10 in comparison to conventional energy generating module fuel tanks.

The fuel chambers 18 may be configured to contain, cumulatively or independently, any desirable amount of fuel. In one exemplary embodiment, the fuel chambers 18 are configured to contain cumulatively about 1,500 gallons of fuel in a 20 foot enclosure 16 having a double-walled fuel chamber 18 with about 150% containment, whereas, a conventional fuel tank in a 20 foot standard ISO container generally holds only about 750 gallons and, thus, provides only about 50% of the runtime of the power generating device in comparison to the present exemplary embodiment. Further, in another exemplary embodiment, the fuel chambers 18 are configured to contain cumulatively about 3,000 gallons of fuel in a 40 foot enclosure 16 having a double-walled fuel chamber 18 with about 150% containment, whereas, a conventional fuel tank in the same sized container generally holds only about 1,500 gallons. In addition, with respect to additional exemplary embodiments of double-walled fuel chambers 18 that provide about 200% containment, the fuel chambers 18 may be configured to contain cumulatively about 1,100 gallons of fuel in a 20 foot enclosure 16 or about 2,200 gallons of fuel in a 40 foot enclosure 16. Conversely, conventional fuel tanks generally hold only about 550 and 1,100 gallons of fuel in 20 foot and 40 foot standard ISO containers, respectively. Therefore, embodiments of double-walled fuel chambers 18 may provide about 200% of the fuel storage capacity generally available with conventional fuel tanks. It is anticipated that embodiments of single-walled fuel chambers 18 described herein may provide even greater than 200% of the fuel storage capacity generally available with conventional fuel tanks as a limiting factor to fuel storage capacity for conventional fuel tanks is their respective heights, which, with the fuel tanks being confined within an interior space of the enclosure, is restricted by the height of the interior workspace within the enclosure.

Further, the modular panels 14 may be configured in any variety of dimensions. These dimensions may be defined to establish specific standards or may be customized to customer needs. For example, generally speaking, United States law allows (without a permit) trailer loads of 102 inches in width to be transported over the road network. Modular panel dimensions may be standardized such that one or more modular panels 14 form an enclosure having a width of 102 inches. Conversely, conventional ISO containers are only 96 inches in width, despite general legal permission to be wider. As such, the enclosure formed by the interconnected complementary modular panels 14 may comprise significantly greater dimensions than the conventional ISO container (i.e., up to 6 inches of additional width along an entire length of the enclosure). The increased area provided in an enclosure having a width of 102 inches and formed by the modular panels 14 may be utilized for any variety of purposes, whether to provide a larger interior to the enclosure, to expand the fuel chambers 18 so as to provide greater fuel capacity, or otherwise. In addition, the modular panels 14 may be configured in any variety of shapes. For example, the modular panels 14 may assume a rectangular or square shape or even a triangular shape. It is contemplated that triangularly shaped modular panels 14 may enhance structural integrity of both the modular panels 14 and the enclosure 16 formed therefrom.

Furthermore, the modular panels 14 may be configured of any variety of materials. For example, the modular panels 14 generally are configured of sheet metal for its durability and rigidity. It is contemplated, however, that the modular panels 14 may be configured of alternative materials in addition to or in lieu of sheet metal. Such alternative materials include, but are not limited to, laminated epoxy, Kevlar® (which may be suitable for military applications), wood, Styrofoam™, and any combinations thereof.

In addition, the modular panels 14 may be configured with flat exterior surfaces. Thereby, the exterior of the modular panels 14, and enclosures 16 formed therefrom, may be easily integrated or aligned with flat surfaces of other modular panels 14, enclosures 16, and/or other devices or facilities. This also provides an enclosure interior having flooring, ceiling, and walls, with flat surfaces, thereby, eliminating sharp, projecting corners into the interior from the flooring or elsewhere. Furthermore, the flat surfaces of the modular panels 14 also facilitate a standardized positioning of holes, fasteners, lifting eyes, etc., to the exterior 16A and/or interior 16B of the enclosure 16. In addition, the flat surfaces of the modular panels 14 easily permit the application of decals, banners, or other marketing/branding promotional materials to the flat surfaces exposed on the exterior 16A of the enclosure 16.

To facilitate lifting and moving of both modular panels 14 and enclosures 16 formed therefrom, lifting eyes and/or other fastening devices may be integrated into the modular panels 14 and exposed at corners, or elsewhere, of the enclosure 16.

The lifting eyes may enable the modular panels 14, the enclosure, and the energy generating module 10 to be easily lifted and maneuvered. Further, the lifting eyes may be used in positioning and interconnecting the modular panels 14 when forming the enclosure 16.

Further, the modular panels 14 may be mass-produced in a variety of standard sizes or may be produced according to custom specifications. The mass-production of the modular panels 14 permits an energy generating module 10 manufacturer to maintain a supply of variously-sized modular panels 14 such that once a customer order is submitted, the manufacturer may simply draw from its supply of modular panels 14 and interconnect those modular panels 14 to create an enclosure 16 for an energy generating module 10. This can reduce the energy generating module 10 manufacturing time from, for example, about four weeks to about three days/one shift. This enables a manufacturer to maintain a lean manufacturing environment. In addition, while it is contemplated that the modular panels 14 may be leak tested after fully assembled to form an enclosure 16, it may be beneficial to subject the modular panels 14 to leak testing at the end of the production process. Thereby, leaks may be more easily identified and repaired and a modular panel 14 may be replaced or otherwise disposed or recycled prior to integration into the enclosure 16.

The configuration of embodiments of the energy generating module 10 with the modular panels 14, and fuel contained therein, may substantially surround an interior 16B of an enclosure 16 of the energy generating module 10, and the energy generating device 12 generally enclosed therein, so as to provide significant sound attenuation of the noise generated by the energy generating device 12. Thereby, baffles and/or other sound-deafening materials positioned about an exterior 16A of an enclosure 16 of the energy generating module 10 and/or the energy generating device 12, as commonly found in the art, is not needed, saving additional time, material, labor, and money involved in use and construction.

Further, as shown in FIG. 4, the fuel chambers 18 may be supported internally by one or more baffles 44 configured to maintain predefined dimensions of the fuel chambers 18. The baffles 44 may be perforated so as to permit passage of fuel therethrough. In addition, as also shown in FIG. 4, the energy generating module 10 may comprise one or more fuel sensors 32 positioned in one or more of the fuel chambers 18 of the modular panels 14 to sense levels of fuel contained therein. It is also contemplated that sound insulating matter, such as, but not limited to concrete, insulation, or other matter, may also be provided internally to the fuel chambers 18 to provide additional noise attenuation benefits while not significantly interfering with a flow of fuel within the fuel chambers 18.

The energy generating module 10 also may comprise one or more sealable ports 34, shown in FIG. 4. The sealable ports 34 may be configured to permit introduction and withdrawal of fuel to and from the fuel chambers 18 of the modular panels 14. The provision of multiple sealable ports 34 to the energy generating module 10 may offer greater refueling flexibility, if access to a sealable port 34 is obstructed or otherwise prevented, and may reduce the time necessary for refueling. It is contemplated that where the fuel chambers 18 are divided internally into multiple, independent cells configured to contain fuel, a sealable port 34 may be provided to each cell. Thereby, in such embodiments, the independent cells may be filled simultaneously with a common fuel or with various types of fuel, further reducing the time necessary to refuel the energy generating module 10.

Fuel utilized by the energy generating module 10 and contained in the fuel chambers 18 is not limited to any particular fuel type. Rather, the fuel may be, but is not limited to, any petroleum-based fuel, such as oil, gasoline, diesel, jet fuel, kerosene, or liquefied natural gas, or any biofuel. It is also contemplated that the fuel may be a compressed or uncompressed gas such as hydrogen, propane, methane, or other gas. In fact, as mentioned above, individually sealed cells of the fuel chambers 18, if present, may contain different types of fuels. This permits not only energy output generation, but also refueling of vehicles that utilize various fuel types through dispensing of fuel from the fuel chambers 18 through a fuel dispensing receptacle of the energy generating module 10. Thereby, not only may a power grid or other electrical system be powered by energy output transferred from the energy generating module 10, but a vehicle utilizing any one of a variety of fuel types may be refueled with fuel in the fuel chambers 18 at the same energy generating module 10. In addition, the storage of various fuel types also enables the energy generating device 12 to use one or more of any variety of fuel types to generate energy output.

In addition, one or more fuel chambers 18 of one energy generating module 10 may be connected to one or more fuel chambers 18 of another nearby energy generating module 10. Thereby, a plurality of interconnected energy generating modules 10 may be provided to produce a greater, cumulative energy output than available through a single, isolated energy generating module 10. For example, but not by way of limitation, multiple adjacent energy generating modules 10 in fluid communication and all configured to and capable of sharing fuel contained in their respective fuel chambers 18 through fuel conveying devices 48, such as hoses, tubes, valves, clamps, etc., may be provided, as shown in FIG. 4. Further, it is contemplated that the energy generating module 10 may be connected to a tanker truck or tanker railcar that may contain several thousand gallons of fuel in addition to that contained in the fuel chambers 18.

Further, it is contemplated that a substantially impenetrable coating or other material may be applied to one or more of the exterior surfaces of the modular panels 14 that may render the need for multiple walls, interstitial spaces, and/or secondary containment tanks unnecessary. More particularly, the coating may substantially prevent projectiles or other foreign objects from piercing the an exterior surface of a modular panel 14. This coating, if applied to the exterior surfaces of a modular panel 14, may eliminate the need for the secondary containment 28 and any protective or insulating material provided therein. This further reduces materials, time, labor, and costs of construction of energy generating modules 10 and permits expansion of the fuel chambers 18 to larger dimensions for increased storage of fuel in lieu of the interstitial spaces. The coating may be applied as a liquid that dries to a substantially impenetrable material about the exterior surfaces of the modular panels 14. Alternatively, the coating may be a material affixed or otherwise provided about the exterior surfaces of the modular panels 14 while in its impenetrable condition, such as in a slab or packaged configuration. It is also contemplated that the coating may assist in attenuating noise generated by the energy generating device 12.

With the energy generating module 10 comprising an energy generating device 12 and modular panels 14 that contain fuel, along with other components necessary for the generation of an energy output, the energy generating module 10 is self-contained and is independent of any outside resources, with the exception of refueling the fuel chambers 18 of the modular panels 14, that may be needed to generate and transfer an energy output and/or fuel. Thereby, the energy generating module 10 may operate independently of personnel, outside of occasional temporary maintenance, refueling, power grid connection/disconnection, and transportation of the energy generating module 10. Remaining operations of the energy generating module 10 may be self-performed by the energy generating modules 10 or may be controlled and/or monitored remotely by a monitoring station configured to communicate with the energy generating module 10 to monitor and/or control one or more conditions of the energy generating module 10. With respect to the refueling of vehicles, according to one exemplary embodiment, vehicle operators may park their vehicles along side an energy generating module 10, couple energy transfer receptacles and/or fuel dispensing receptacles, or other similar devices, of the energy generating module 10 to their vehicles, and transfer energy output and/or dispense fuel from the energy generating module 10 to the vehicle for re-energizing and/or refueling purposes. Further, the energy generating modules 10 may be configured such that vehicle operators may transact energy output and/or fuel purchases through credit card or other payment transactions, eliminating the need for personnel on site to handle payment arrangements. For example, but not by way of limitation, vehicle operators may swipe a credit cards in a card-reading mechanism affixed to and/or linked with the energy generating module 10 to pre-pay for the energy output and/or fuel, as currently offered at most fueling stations.

Also, the energy generating module 10 generally comprises additional components that may be necessary for, or facilitative of, energy output generation. These additional components may include, but are not limited to: an alternator, a battery or other energy-storing device, DC lighting systems, electrical controls such as engine switchgear or a voltage changeover board, sound attenuation, fire suppression systems, personnel doors, fuel tank, louvers for ventilation, fan cooling system, and an exhaust system. Any combination of these items may be considered to be an energy generating module 10. The exhaust system may be configured to include environmentally-friendly scrubbers to remove, or substantially remove, toxic or harmful substances from the exhaust generated by the energy generating device 12, such as NOx. Further, for construction of the energy generating module 10, the energy generating device 12, alternator, electrical controls, air circulation, exhaust systems, and other components may be manufactured in and/or provided by separate facilities. Once constructed and appropriately configured, the energy generating device 12 may be placed within an interior 16B of the enclosure 16 of the energy generating module 10.

It is contemplated that the energy generating module 10 also may comprise a battery or other energy storing device such that energy output generated by the energy generating device 12 may be stored for transfer to an energy consuming or transferring device or system at a later time. The energy output may be transferred to any device or system consuming, transferring, or otherwise utilizing the generated energy output.

Further, as shown in FIG. 3, the energy generating module 10 may comprise a modular cage 36 to support the energy generating device 12, and possibly other components positioned within the interior 16B of the enclosure 16, such as, but not limited to, a radiator and an alternator integrated into the energy generating device 12, during transportation of the energy generating module 12. More particularly, the energy generating device 12 may be supportedly affixed to the modular cage 36 with the assembly thereof being placed into the interior of the enclosure 16. The modular cage 36 may support the energy generating device 12 such that while the modular cage 36 is secured within the interior of the enclosure 16, the energy generating device 12 may sway so as to be self-leveling, or substantially self-leveling with movement of the energy generating module 10 during transportation thereof. By way of example only, the modular cage 36 may function similarly to a gyroscope in maintaining stability through adjustable self-leveling. In addition, or alternative thereto, the modular cage 36 may comprise an independent suspension within the interior 16B of the enclosure 16 to provide self-leveling capabilities to the modular cage 36 and the energy generating device 12. As such, the modular cage 36 may protect the energy generating device 12, and any other components supported by the modular cage 36, from damage during transportation and may substantially reduce tilting of a chassis, trailer, or railcar transporting the energy generating module 10. The modular cage 36 may be designed to fit securely within and according to the dimensions of an enclosure 16. In addition, the modular cage 36 may be designed for repeated, rapid insertion and withdrawal to and from an enclosure 16. For example, as shown in FIG. 3, one or more guide rails 38 may be secured to a modular panel 14 serving as a floor panel of the enclosure 16 to receive and releasably lock into place the modular cage 36 supporting an energy generating device 12. Such features of the modular cage 36 permit greater flexibility of the energy generating module 10 and the use of its components, which may be interchangeable within enclosures 16 and energy generating modules 10, assuming a "plug-and-play" configuration.

Further, while the modular panels 14 are described herein as comprising fuel chambers 18 configured to contain fuel, it is contemplated that the modular panels 14 may be used for purposes other than, or in addition to, containing fuel. In fact, the modular panels 14 may be used to contain any fluid, liquid or gas. In addition, the modular panels 14 may provide accessible, hollow spaces in which various goods and/or supplies may be stored. The storage modular panels 14 may be accessible from the exterior 16A of the enclosure 16 or from the interior 16B of the enclosure 16, or both. The storage modular panels 14 may be configured to contain any variety of goods or operational components of the energy generating module 10, or both. Also, the modular panels 14 may contain insulation for temperature regulating purposes and/or insulation or other material for sound attenuation or reduction purposes. Further, for example, it is contemplated that an enclosure 16 may be formed by modular panels 14 containing fuel, modular panels 14 containing insulation, modular panels 14 containing sound reduction panels, modular panels 14 storing supplies, modular panels 14 storing a ladder to facilitate access to the interior 16B of the enclosure 16, and modular panels 14 internally divided into distinct cells containing one or more of the above, or other goods, and any combinations thereof. It is also contemplated that modular panels 14 may be configured as other panels that may contributed to the forming of an enclosure of an energy generating module. For example, as shown in FIG. 3, the modular panels 14 may be configured as a door panel 40 and a louver panel 42. Such alternative modular panels 14 may also comprise one or more of the multi-functional inter-panel coupling ports 20 such that alternative modular panels 14 complementary to each other and/or other modular panels 14 may interconnect to assist in the forming of an enclosure 16.

Further, it is contemplated that not only may the energy generating module 10 be used for industrial, construction, mining, oil and gas exploration, commercial applications, and/or other applications as described herein, but the energy generating modules 10 may be used for marine applications as well. More particularly, an energy generating module 10 may be positioned on a dock, wharf, or other water-side location such that the energy generating module 10 may provide an energy output to a ship, boat, or other water vessel to charge an energy storage device of the vessel or to refuel the vessel with a fuel contained within the fuel chambers 18 of the modular panels 14. In addition, an energy generating module 10 may be placed on-board of a water vessel to provide prime or back-up electric power for the vessel and/or for fuel for vehicles also on-board of the vessel.

It should be noted that embodiments of the modular panels 14 and/or fuel chambers 18 described herein do not attempt to improve upon existing fuel containment regulations, standards, or guidelines, such as the Underwriters Laboratories Inc.'s standards (see UL 142 and 2085). Further, it is contemplated that the energy generating module 10, the modular panels 14, and the fuel chambers 18 may be configured and manufactured in accordance with UL standards 142, 2085, and/or any other standards, regulations, or guidelines.

It is noted that recitations herein of a component of an embodiment being "configured" in a particular way or to embody a particular property, or function in a particular manner, are structural recitations as opposed to recitations of intended use. More specifically, the references herein to the manner in which a component is "configured" denotes an existing physical condition of the component and, as such, is to be taken as a definite recitation of the structural characteristics of the component.

It is noted that terms like "generally" and "typically," when utilized herein, are not utilized to limit the scope of the claimed embodiments or to imply that certain features are critical, essential, or even important to the structure or function of the claimed embodiments. Rather, these terms are merely intended to identify particular aspects of an embodiment or to emphasize alternative or additional features that may or may not be utilized in a particular embodiment.

For the purposes of describing and defining embodiments herein it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

Having described embodiments of the present invention in detail, and by reference to specific embodiments thereof, it will be apparent that modifications and variations are possible without departing from the scope of the embodiments defined in the appended claims. More specifically, although some aspects of embodiments of the present invention are identified herein as preferred or particularly advantageous, it is contemplated that the embodiments of the present invention are not necessarily limited to these preferred aspects.

What is claimed is:

1. An energy generating module comprising an energy generating device and a plurality of modular panels, wherein:

the modular panels comprise fuel chambers that are configured to contain fuel;

the modular panels respectively comprise one or more multi-functional inter-panel coupling ports;

the multi-functional inter-panel coupling ports are positioned to facilitate multi-purpose modular interconnection of complementary modular panels;

the multi-functional inter-panel coupling ports exhibit a degree of structural rigidity sufficient to contribute to the immobilization of interconnected complementary modular panels relative to each other;

the multi-functional inter-panel coupling ports comprise fluid passages for conveying fuel between interconnected complementary modular panels;

the complementary modular panels are interconnected via the multi-functional inter-panel coupling ports to form an enclosure such that the fuel chambers of the interconnected complementary modular panels are disposed between an exterior of the enclosure and an interior of the enclosure; and the energy generating device is in fluid communication with one or more of the fuel chambers and is configured to generate an energy output with fuel received from the fuel chambers.

2. The energy generating module of claim 1, wherein the multi-functional inter-panel coupling ports permit disengagement of interconnected complementary modular panels.

3. The energy generating module of claim 1, wherein the multi-functional inter-panel coupling ports interlock to inhibit disengagement of interconnected complementary modular panels.

4. The energy generating module of claim 1, wherein the modular panels further comprise one or more release mechanisms to control release of interlocked multi-functional inter-panel coupling ports to permit disengagement of interconnected complementary modular panels.

5. The energy generating module of claim 1, wherein:

the enclosure formed by the interconnected complementary modular panels is supported by a frame that provides additional structural rigidity to the interconnected complementary modular panels to contribute to the immobilization of interconnected complementary modular panels relative to each other, and the frame is configured to protect exterior corners of the enclosure from damage during re-positioning or transportation, or both, of the energy generating module.

6. The energy generating module of claim 1, wherein one or more of the modular panels further comprise storage chambers in addition to the fuel chambers, the fuel chambers being sealed to prevent leakage of fuel into the storage chambers.

7. The energy generating module of claim 1, wherein the multi-functional inter-panel coupling ports comprise seals, gaskets, o-rings, other sealing devices, or combinations thereof, to prevent leakage of fuel from between the interconnected complementary modular panels.

8. The energy generating module of claim 1, wherein the multi-functional inter-panel coupling ports are configured as complementary pins and recesses.

9. The energy generating module of claim 1, wherein the multi-functional inter-panel coupling ports are configured as complementary tongue and groove connectors.

10. The energy generating module of claim 1, wherein the multi-functional inter-panel coupling ports are configured as complementary dovetail connectors.

11. The energy generating module of claim 1, wherein:

the fuel chambers comprise a primary containment tank contained within a secondary containment tank, the primary containment tank is configured to contain fuel, and the primary and secondary containment tanks are separated by one or more interstitial spaces.

12. The energy generating module of claim 11, wherein:

the interstitial spaces are configured to collect fuel leaking from the primary containment tank, and the energy generating module further comprises one or more fuel sensors positioned in the interstitial spaces to sense a presence of fuel in the interstitial spaces.

13. The energy generating module of claim 11, wherein one or more of the interstitial spaces are at least partially filled with concrete, insulation, or other matter.

14. The energy generating module of claim 1, wherein:

the fuel chambers are supported internally by one or more baffles configured to maintain predefined dimensions of the fuel chambers, and the baffles are perforated so as to permit passage of fuel therethrough.

15. The energy generating module of claim 1, wherein the energy generating module further comprises one or more fuel sensors positioned in one or more of the fuel chambers of the modular panels to sense levels of fuel contained therein.

16. The energy generating module of claim 1, wherein the energy generating module comprises one or more sealable ports configured to permit introduction of fuel to the fuel chambers of the modular panels.

17. The energy generating module of claim 1, wherein the energy generating module further comprises one or more fuel conveying devices configured to convey fuel from the fuel chambers of the modular panels to the energy generating device.

18. The energy generating module of claim 1, wherein the energy generating device is a power generating device configured to generate electric power output with fuel received from the fuel chambers of the modular panels.

19. A power generating module comprising a power generating device and a plurality of modular panels, wherein:

the modular panels comprise fuel chambers that are configured to contain fuel;

the modular panels respectively comprise one or more multi-functional inter-panel coupling ports configured as complementary pins and recesses;

the multi-functional inter-panel coupling ports are positioned to facilitate multi-purpose modular interconnection of complementary modular panels;

the multi-functional inter-panel coupling ports exhibit a degree of structural rigidity sufficient to contribute to the immobilization of interconnected complementary modular panels relative to each other;

the multi-functional inter-panel coupling ports comprise fluid passages for conveying fuel between interconnected complementary modular panels;

the complementary modular panels are interconnected via the multi-functional inter-panel coupling ports to form an enclosure such that the fuel chambers of the interconnected complementary modular panels are disposed between an exterior of the enclosure and an interior of the enclosure; and the power generating device is in fluid communication with one or more of the fuel chambers and is configured to generate an electric power output with fuel received from the fuel chambers.

* * * * *

UNITED STATES PATENT AND TRADEMARK OFFICE

CERTIFICATE OF CORRECTION

PATENT NO. : 8,207,621 B2
APPLICATION NO. : 12/205442
DATED : June 26, 2012
INVENTOR(S) : Jefferey Allen Hunter It is certified that error appears in the above-identified patent and that said Letters Patent is hereby corrected as shown below:

Col. 2, Line 11, “in order reduce” should read -- in order to reduce --;

Col. 3, Line 61, “fuel receive from” should read -- fuel received from --;

Col. 4, Line 7, “is an fuel-driven” should read -- is a fuel-driven --;

Col. 5, Line 3, “noise though specially” should read -- noise through specially --;

Col. 5, Line 3, “the amount noise” should read -- the amount of noise --;

Col. 5, Line 14, “to fuel to flow” should read -- to fuel the flow --;

Col. 8, Line 11, “tanks is their respective height” should read -- tanks in their respective height --;

Col. 10, Line 42, “the an exterior” should read -- the exterior --;

Col. 11, Line 22, “may swipe a credit cards” should read -- may swipe a credit card --; and Col. 12, Line 51, “contributed” should read -- contribute --.

Signed and Sealed this
Twenty-fifth Day of September, 2012

David J. Kappos

David J. Kappos
*Director of the United States Patent and Trademark Office*